US011459800B2

(12) United States Patent
Carreon et al.

(10) Patent No.: US 11,459,800 B2
(45) Date of Patent: Oct. 4, 2022

(54) PACKAGE WRAP

(71) Applicant: InVue Security Products Inc., Charlotte, NC (US)

(72) Inventors: Ronaldo Carreon, Charlotte, NC (US); Christopher J. Fawcett, Charlotte, NC (US); David N. Berglund, Indian Trail, NC (US); John A. Buchanan, Indian Land, SC (US); Robert Bisesti, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 0 days.

(21) Appl. No.: 16/916,964

(22) Filed: Jun. 30, 2020

(65) Prior Publication Data

US 2020/0332566 A1 Oct. 22, 2020

Related U.S. Application Data

(63) Continuation of application No. 15/988,741, filed on May 24, 2018, now abandoned.

(Continued)

(51) Int. Cl.
*E05B 73/00* (2006.01)
*E05B 45/00* (2006.01)

(52) U.S. Cl.
CPC ..... *E05B 73/0029* (2013.01); *E05B 45/005* (2013.01); *E05B 73/0011* (2013.01)

(58) Field of Classification Search
CPC .... E05B 45/005; E05B 67/003; E05B 67/006; E05B 73/00; E05B 73/0005; E05B 73/0011; E05B 73/0029
See application file for complete search history.

(56) References Cited

U.S. PATENT DOCUMENTS 5,464,092 A 11/1995 Seeley
5,722,266 A 3/1998 Yeager et al.
(Continued)

FOREIGN PATENT DOCUMENTS

EP 1027514 B1 4/2002
WO 2009100857 A1 8/2009
(Continued)

OTHER PUBLICATIONS

Shane Thomas, Notification of Transmittal of the International Search Report and the Written Opinion of the International Searching Authority, of the Declaration of International (PCT) Application No. PCT/US2014/065448, dated Feb. 26, 2015, 10 pages, Commissioner for Patents, Alexandria, Virginia.

(Continued)

*Primary Examiner* — Christopher J Boswell
(74) *Attorney, Agent, or Firm* — InVue Security Products Inc.

(57) ABSTRACT

A merchandise security device is provided. The merchandise security device may include a housing operably coupled with a cable. The cable is configured to be extended and retracted relative to the housing and to at least partially surround an item of merchandise. The merchandise security device may also include at least one sensor operably engaged with the housing and configured to detect unauthorized movement of the housing relative to the item of merchandise. The merchandise security device may further include a lock mechanism configured to lock the cable about the item of merchandise.

20 Claims, 4 Drawing Sheets

Related U.S. Application Data

(60) Provisional application No. 62/510,983, filed on May 25, 2017.

(56) References Cited

U.S. PATENT DOCUMENTS

| | | | |
|---|---|---|---|
| 5,794,464 | A | 8/1998 | Yeager et al. |
| 5,960,652 | A | 10/1999 | Marmstad |
| 6,092,401 | A | 7/2000 | Sankey et al. |
| 6,237,375 | B1 | 5/2001 | Wymer |
| 6,755,055 | B2 | 6/2004 | Sedon et al. |
| 6,933,847 | B2 | 8/2005 | Feibelman |
| 7,062,823 | B2 | 6/2006 | Copen et al. |
| 7,129,841 | B2 | 10/2006 | Feibelman |
| 7,162,899 | B2 | 1/2007 | Fawcett et al. |
| 7,168,275 | B2 | 1/2007 | Fawcett et al. |
| D545,228 | S | 6/2007 | Fawcett et al. |
| 7,227,467 | B2 | 6/2007 | Fiebelman |
| 7,249,401 | B2 | 7/2007 | Copen et al. |
| 7,251,966 | B2 | 8/2007 | Fawcett et al. |
| D555,023 | S | 11/2007 | Fawcett et al. |
| D555,024 | S | 11/2007 | Fawcett et al. |
| D556,072 | S | 11/2007 | Fawcett et al. |
| 7,350,381 | B2 | 4/2008 | Fawcett et al. |
| 7,403,118 | B2 | 7/2008 | Belden, Jr. |
| 7,453,370 | B2 | 11/2008 | Marsilio et al. |
| 7,474,209 | B2 | 1/2009 | Marsilio et al. |
| 7,481,086 | B2 | 1/2009 | Fawcett et al. |
| 7,497,100 | B2 | 3/2009 | Fawcett et al. |
| 7,497,101 | B2 | 3/2009 | Fawcett et al. |
| 7,518,521 | B2 | 4/2009 | Feibelman et al. |
| 7,522,048 | B2 | 4/2009 | Belden, Jr. |
| 7,659,817 | B2 | 2/2010 | Conti et al. |
| 7,685,850 | B2 | 3/2010 | Nilsson |
| 7,737,844 | B2 | 6/2010 | Scott et al. |
| 7,808,382 | B2 | 10/2010 | Bonato |
| 7,918,112 | B2 | 4/2011 | Fawcett et al. |
| 7,984,629 | B2 | 7/2011 | Xiaobin |
| 7,992,259 | B2 | 8/2011 | Goldstein et al. |
| 8,087,269 | B2 | 1/2012 | Conti et al. |
| 8,122,744 | B2 | 2/2012 | Conti et al. |
| 8,144,014 | B1 | 3/2012 | Yang |
| 8,228,192 | B2 | 7/2012 | Exkert et al. |
| 8,274,391 | B2 | 9/2012 | Yang |
| 8,281,626 | B2 | 10/2012 | Conti et al. |
| 8,305,219 | B2 | 11/2012 | Yang |
| 8,341,985 | B2 | 1/2013 | Ezzo et al. |
| 8,347,663 | B2 | 1/2013 | Fawcett et al. |
| 8,368,542 | B2 | 2/2013 | Yang |
| 8,368,543 | B2 | 2/2013 | Yang |
| 8,373,565 | B2 | 2/2013 | Yang |
| 8,373,566 | B2 | 2/2013 | Yang |
| 8,375,524 | B2 | 2/2013 | Goldstein et al. |
| 8,408,472 | B2 | 4/2013 | Yang |
| 8,499,595 | B2 | 8/2013 | Zhang et al. |
| 8,528,372 | B2 | 9/2013 | Nilsson |
| 8,599,022 | B2 | 12/2013 | Conti et al. |
| 8,640,509 | B2 | 2/2014 | Will |
| 8,773,267 | B2 | 7/2014 | Conti et al. |
| 8,800,330 | B2 | 8/2014 | Fawcett et al. |
| 8,860,574 | B2 | 10/2014 | Grant et al. |
| 8,890,689 | B2 | 11/2014 | Ezzo et al. |
| 8,938,997 | B2 | 1/2015 | Piccoli et al. |
| 9,133,649 | B2 | 9/2015 | Taylor et al. |
| 9,169,670 | B2 | 10/2015 | Shute et al. |
| 9,394,727 | B2 * | 7/2016 | Fawcett ..... E05B 73/0011 |
| 9,404,291 | B1 | 8/2016 | White et al. |
| 9,524,626 | B2 | 12/2016 | Bruhwiler et al. |
| 9,934,665 | B1 | 4/2018 | Zhang |
| 9,953,498 | B2 | 4/2018 | Van Landingham, Jr. et al. |
| 10,180,017 | B2 | 1/2019 | Ewing et al. |
| 2002/0129628 | A1 | 9/2002 | Skalberg |
| 2006/0157607 | A1 | 7/2006 | Kohlndofer et al. |
| 2007/0131005 | A1 | 6/2007 | Clare |
| 2007/0152819 | A1 | 7/2007 | Marszalek et al. |
| 2008/0226421 | A1 | 9/2008 | Rudduck et al. |
| 2008/0276671 | A1 * | 11/2008 | Lu ..... E05B 73/0005 70/263 |
| 2009/0058643 | A1 | 3/2009 | Groth |
| 2009/0322531 | A1 | 12/2009 | Estevez et al. |
| 2010/0139336 | A1 * | 6/2010 | Necchi ..... E05B 73/0005 70/57.1 |
| 2010/0231388 | A1 | 9/2010 | Shute et al. |
| 2010/0315237 | A1 | 12/2010 | Yang |
| 2011/0094274 | A1 | 4/2011 | Conti et al. |
| 2011/0115632 | A1 | 5/2011 | Yang |
| 2011/0227706 | A1 | 9/2011 | Yang |
| 2011/0254661 | A1 | 10/2011 | Fawcett et al. |
| 2011/0260594 | A1 | 10/2011 | Yang |
| 2012/0019383 | A1 | 1/2012 | Fawcett et al. |
| 2012/0047972 | A1 | 3/2012 | Grant et al. |
| 2012/0050042 | A1 | 3/2012 | Shute et al. |
| 2012/0085134 | A1 | 4/2012 | Ezzo et al. |
| 2012/0210755 | A1 | 8/2012 | Shafer |
| 2012/0227446 | A1 | 9/2012 | Shute et al. |
| 2012/0227447 | A1 | 9/2012 | Conti |
| 2012/0267436 | A1 | 10/2012 | Yang |
| 2012/0318027 | A1 | 12/2012 | Shute et al. |
| 2013/0067968 | A1 | 3/2013 | Ezzo |
| 2013/0098122 | A1 | 4/2013 | Eckert et al. |
| 2013/0255335 | A1 | 10/2013 | Jonely |
| 2014/0266729 | A1 | 9/2014 | Perreau et al. |
| 2014/0305828 | A1 | 10/2014 | Salvo |
| 2014/0318192 | A1 | 10/2014 | Conti et al. |
| 2014/0345336 | A1 | 11/2014 | Fawcett et al. |
| 2015/0287299 | A1 | 10/2015 | Eckert et al. |
| 2016/0049055 | A1 | 2/2016 | Berglund et al. |
| 2016/0307417 | A1 | 10/2016 | Van Landingham, Jr. et al. |
| 2017/0193771 | A1 | 7/2017 | Will et al. |
| 2018/0283054 | A1 | 10/2018 | Llewellyn et al. |
| 2018/0340357 | A1 | 11/2018 | Carreon et al. |
| 2019/0088094 | A1 | 3/2019 | Van Landingham, Jr. et al. |

FOREIGN PATENT DOCUMENTS

| | | | |
|---|---|---|---|
| WO | 2013134131 | A1 | 9/2013 |
| WO | 2015073668 | A1 | 5/2015 |

OTHER PUBLICATIONS

Extended European Search Report from corresponding EP Application No. 14861894.5, dated Oct. 6, 2016 (9 pages).
U.S. Appl. No. 16/866,040, filed May 4, 2020.

* cited by examiner

PACKAGE WRAP

CROSS REFERENCE TO RELATED APPLICATION

This application is a continuation of U.S. application Ser. No. 15/988,741, filed on May 24, 2018, which claims the benefit of U.S. Provisional Appl. No. 62/510,983, filed on May 25, 2017, the entire disclosures of which are hereby incorporated by reference.

FIELD OF THE INVENTION

Embodiments of the present invention relate generally to merchandise security systems and methods for protecting an item of merchandise from theft.

BACKGROUND OF THE INVENTION

It is common practice for retailers to store and/or display items of merchandise on or within a merchandise security device, such as a security display (e.g. alarming stand), security fixture (e.g. locking hook, shelf, cabinet, etc.) or security packaging (e.g. merchandise keeper). Regardless, the merchandise security device stores and/or displays an item of merchandise so that a potential purchaser may view, and in some instances, interact with the merchandise before making a decision whether to purchase the item. At the same time, the item is secured on or within the merchandise security device so as to prevent, or at least deter, theft of the item. The value of the item, however, may make it an attractive target for a shoplifter despite the presence of a merchandise security device. A determined shoplifter may attempt to detach the item from the security display or remove the item from the security fixture or from within the security packaging. Alternatively, the shoplifter may attempt to remove all or a portion of the merchandise security device from the display area along with the item of merchandise.

BRIEF SUMMARY

Embodiments of the present invention are directed towards merchandise security devices and methods for securing an item of merchandise from theft. In one example, a merchandise security device includes a housing operably coupled with a cable, wherein the cable is configured to be extended and retracted relative to the housing and to at least partially surround an item of merchandise. The merchandise security device also includes at least one sensor operably engaged with the housing and configured to detect unauthorized movement of the housing relative to the item of merchandise. In one embodiment, the sensor is configured to detect unauthorized movement of the housing relative to the item of merchandise in three dimensions. In addition, the merchandise security device includes a lock mechanism configured to lock the cable about the item of merchandise.

In another embodiment, a method includes positioning a housing adjacent to two sides of the item of merchandise and over an edge of the item of merchandise, wherein the housing is operably coupled with a cable configured to be extended and retracted relative to the housing. The method also includes at least partially surrounding the item of merchandise with the cable and engaging a lock mechanism for releasably securing the cable relative to the housing to prevent extension of the cable relative to the housing but not to prevent retraction of the cable within the housing.

DETAILED DESCRIPTION OF EMBODIMENTS OF THE INVENTION

Figure 1:
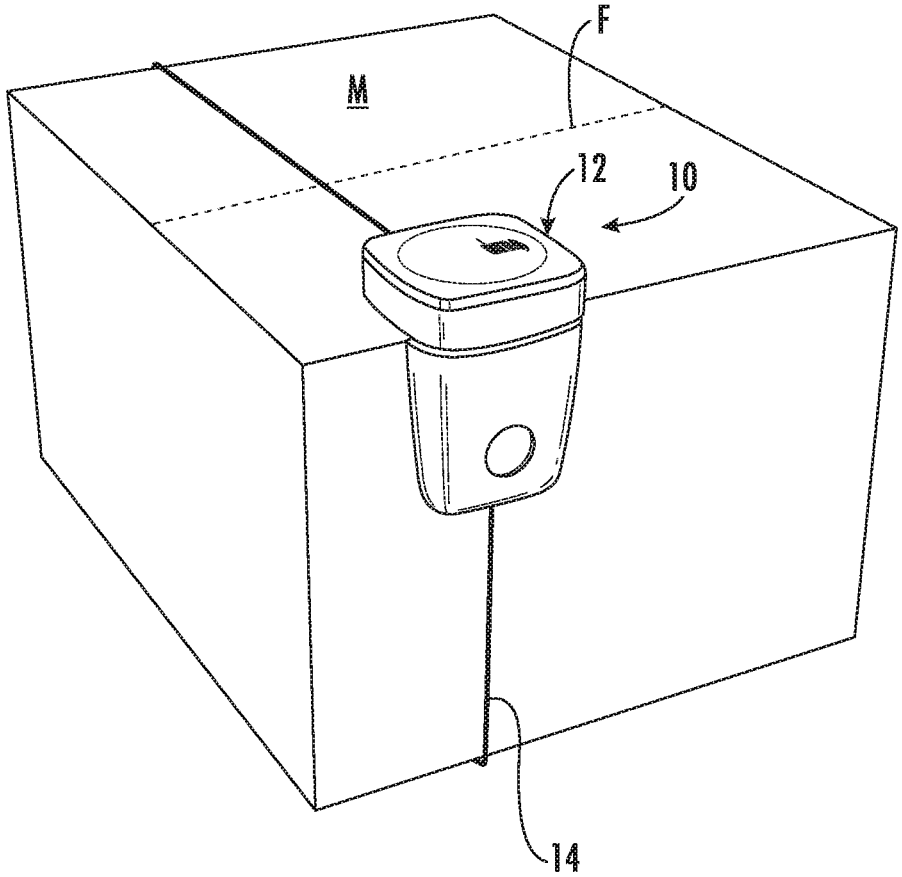
FIG. 1 is a perspective view of a merchandise security device secured to an item of merchandise according to one embodiment of the present invention.

Referring now to the accompanying drawing figures wherein like reference numerals denote like elements throughout the various views, one or more embodiments of a merchandise security system are shown. In some embodiments shown and described herein, the merchandise security device is employed for securing items of merchandise from theft. For example, the merchandise security device may be suitable for use with a variety of different items of merchandise, including packages containing items of merchandise. The item of merchandise may be any desired shape, such as a box-like structure.

Turning now to exemplary embodiments of the present invention, FIGS. 1-5 illustrate an embodiment of a merchandise security device 10. FIG. 1 shows that the merchandise security device 10 generally includes a housing 12 operably coupled with a cable 14. As shown in FIG. 1, the cable 14 is configured to extend at least partially about an item of merchandise M. In one example, where the item of merchandise M is a six-sided item (e.g., a box), the cable 14 is configured to extend about four sides of the item. In this example, the cable 14 may extend perpendicular to the open edges of the flaps F of the item of merchandise.

Figure 2:
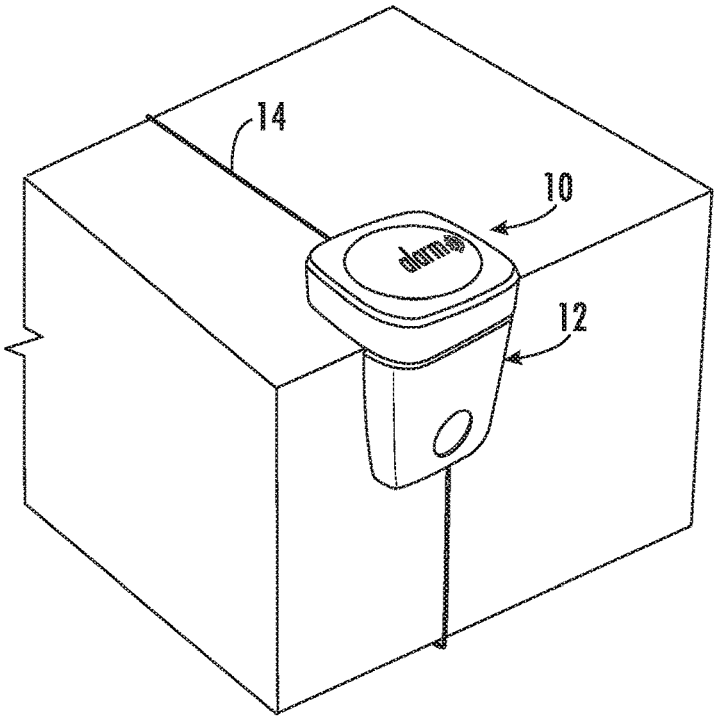
FIG. 2 is an enlarged view of the merchandise security device shown in FIG. 1.
Figure 3:
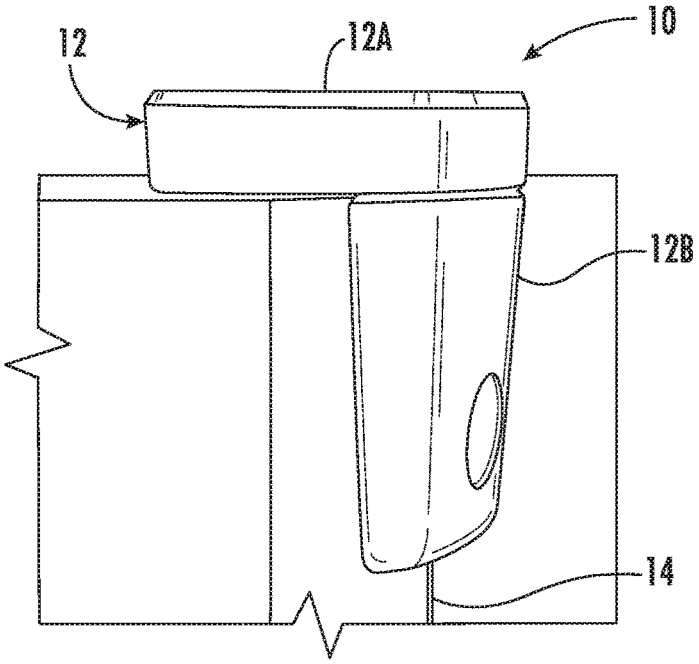
FIG. 3 is a side perspective view of the merchandise security device shown in FIG. 1

In one embodiment, the housing 12 is configured to be positioned adjacent to one of the sides of the item of merchandise M, such as on the top side of the item of merchandise. In the illustrated embodiment, the housing 12 is configured to be positioned adjacent to two sides of the item of merchandise and to extend over an edge of the item of merchandise. Thus, the housing 12 and cables 14 do not detract from the presentation of the item of merchandise M, which is unlike conventional cable wraps that require the security device to be positioned on all surfaces and the center of at least one side of the item of merchandise, which may hinder the visibility of relevant information, as well as hinder the ability to stack items of merchandise adjacent to one another in a compact manner. The housing 12 may be configured to be positioned adjacent to the item of merchandise M and held in place under the tension of the cable 14. In some cases, the housing 12 may be secured to the item of merchandise with the cable 14 alone or in combination with other features, such as via an adhesive, high friction materials, or a sled. For instance, a high-friction material could be provided on an underside of the housing 12 that engages the item of merchandise to limit sliding of the housing relative to the item of merchandise. As shown in FIGS. 1-3, the housing 12 may have a generally L-shape for being positioned adjacent to two sides of the item of merchandise, although other shapes may be contemplated in other embodiments. For example, FIG. 3 shows a first portion 12A of the housing 12 is configured to be positioned on a top surface of the item of merchandise, and a second portion 12B of the housing is configured to be positioned on a side surface of the item of merchandise.

Figure 4:
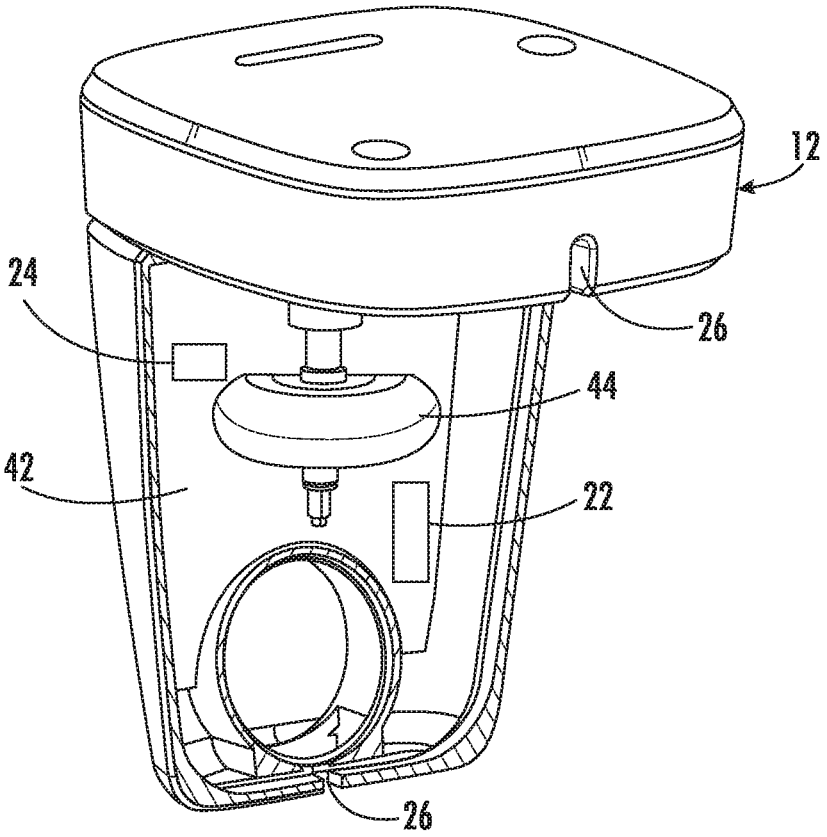
FIG. 4 is partial perspective view of a merchandise security device according to another embodiment of the present invention.

In some embodiments, the cable 14 is a cord or tether that provides mechanical security only, while in other embodiments, the cable 14 may include one or more conductors electrically connected to an alarm circuit 24 contained within the housing 12 (see, e.g., FIG. 4, where a portion of the housing has been removed for purposes of illustration). In other embodiments, the cable 14 may include both a cut resistant outer sheath and conductors, although only a cable having a cut-resistant outer sheath may be utilized if desired. The cable 14 may be flexible so as to be able to extend about and conform to the peripheral shape of the item of merchandise M. In some embodiments, the cable 14 includes at least one conductor for defining a sense loop therethrough. The housing 12 may contain an alarm circuit 24 in communication with the sense loop that is configured to detect when the cable 14 has been cut, severed or removed from the housing. The alarm circuit 24 may be configured to generate an audible and/or a visible alarm signal in response to interruption of the sense loop. Furthermore, the cable 14 may be a single continuous loop. In this regard, only one cable 14 is required to secure the housing 12 to the item of merchandise M. In some cases, each end of the cable 14 may be secured within the housing 12 to form a single loop. Thus, unlike conventional cable wraps, more than one cable 14 is not required, although it is possible that more than one cable could be used if desired.

Moreover, the housing 12 may include an EAS tag or other mechanism configured to provide a signal for generating an alarm signal or to cause a remote alarm signal to be generated when the security device 10 is proximate to a gate or exit. The housing 20 may also include a power source 22 for providing power to the alarm circuit 24, and in some embodiments provide power to an LED. The alarm circuit 24 and power source 22 may be located on a printed circuit board 42 (PCB) disposed within the housing 20 (see, e.g., FIG. 4).

In one embodiment, the cable 14 is configured to be manually unwound from the housing 12 for extending the cable out of the housing, such as by applying tension to the cable. Likewise, the cable 14 may be configured to retracted within the housing 12. The housing 12 includes a spool 20 that is configured to rotate relative to the housing 12. The spool 20 is rotatably coupled to the housing 12 such that the spool may be rotated clockwise or counterclockwise relative to the housing. Thus, the cable 14 may be configured to be tightened around an item of merchandise M for securing the housing 12 to the item of merchandise and to be loosened for removing the housing and cable from the item of merchandise. The spool 20 may be configured to receive the cable 14, wherein the cable may be wound and unwound from the spool. The housing 12 may define a plurality of openings 26 configured to receive the cable 14 therethrough. In one example, the housing 12 includes a pair of openings 26 that are disposed radially opposite one another. The cable 14 may be configured to be displaced through each of the openings 26 as the cable is tightened and loosened.

Figure 5:
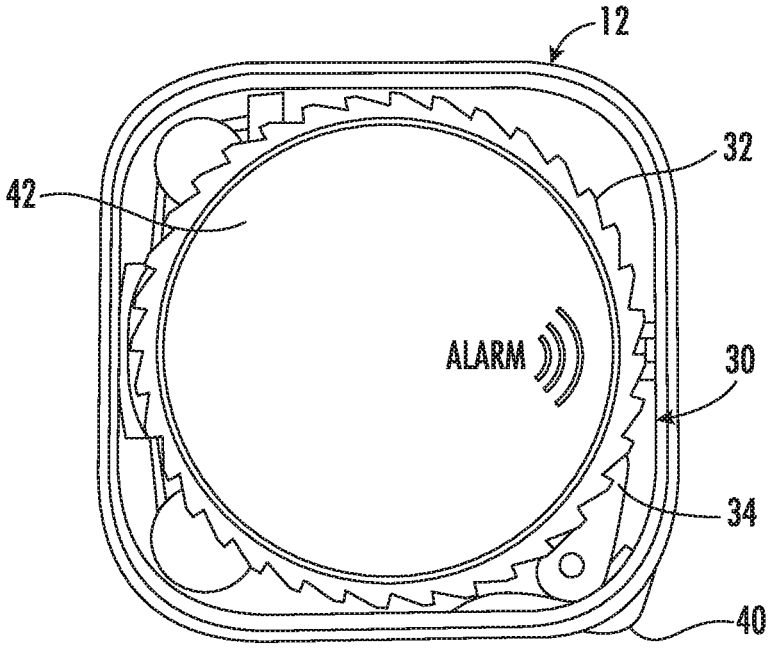
FIG. 5 is a top view of a merchandise security device according to one embodiment of the present invention.
Figure 6:
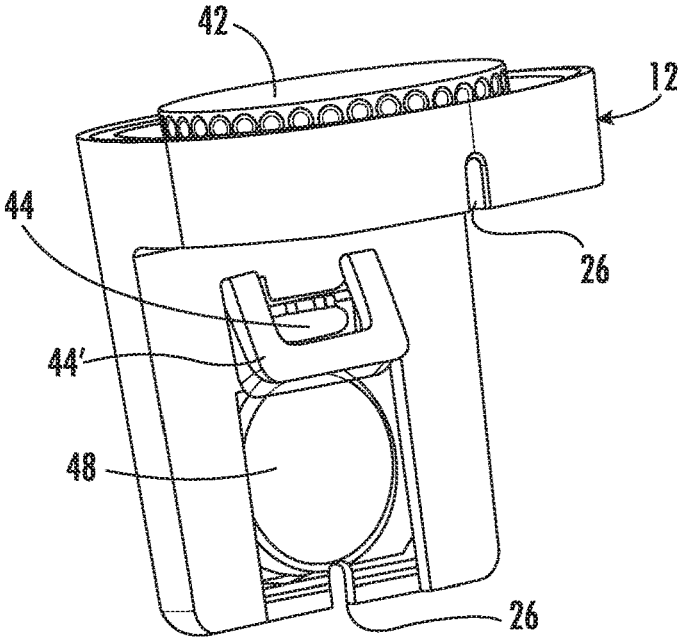
FIG. 6 is a perspective view of the merchandise security device shown in FIG. 5.
Figure 7:
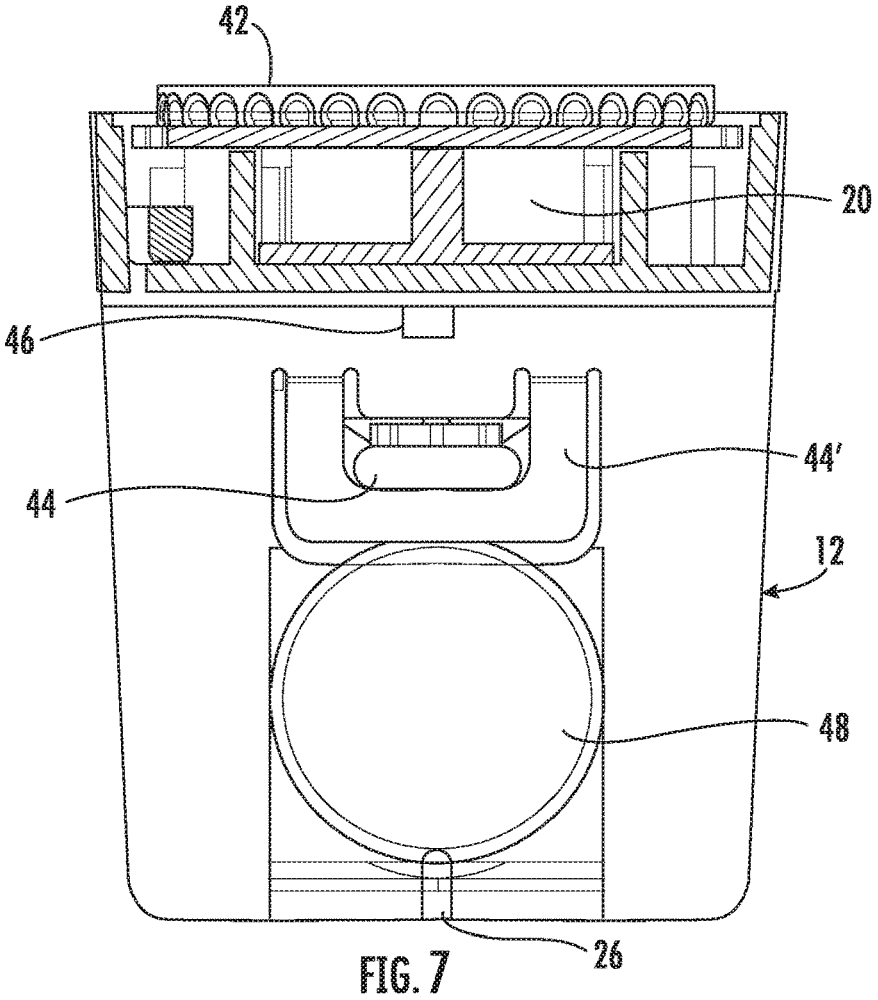
FIG. 7 is a cross-sectional view of the merchandise security device shown in FIG. 6.

FIGS. 5-7 show the housing 12 of the merchandise security device 10 further includes a lock mechanism 30. The lock mechanism 30 may be configured to be moved between a locked position and an unlocked position. In the locked position, the cable 14 may be locked relative to the housing 12 such that the cable is unable to be withdrawn out of the housing. In one example, the locking mechanism 30 is a ratchet mechanism having a plurality of ratchet teeth 32 and at least one locking member 34 (e.g., a pawl) that is configured to be moved for limiting or preventing rotation of the spool 20 in a loosening direction. The locking member 34 is configured to move into engagement with one or more ratchet teeth 32 such that the spool 20 can be rotated in a winding direction to tighten the cable 14 about the item of merchandise M. In addition, the locking member 34 may be configured to engage the ratchet teeth 32 when the spool 20 is rotated in a direction that unwinds the cable 14 from the spool such that the cable is unable to be extended from the housing 12. However, the spool 20 is able to at least partially rotate in a direction that allows the cable 14 to be wound onto the spool. In some instances, the locking member 34 may be configured to pivot or rotate between an unlocked position and a locked position in engagement with the ratchet teeth 32. In some embodiments, the locking mechanism 30 may include a manual actuator 40 for moving the locking member 34 to the locked and/or unlocked position. For instance, the manual actuator 40 could be coupled to the pawl and configured to move the pawl inward or outward relative to the ratchet teeth 32. In some cases, the manual actuator 40 may be configured to be actuated to an unlocked position, which may occur after disarming the alarm circuit 24, and unwinding of the cable 14 from the spool 12 may occur while the manual actuator is actuated. Releasing the manual actuator 42 may allow the locking member 34 to automatically return to the locked position. In some cases, the locking member 34 may be biased towards the locked position, and the manual actuator 40 is configured to overcome the bias force to disengage the locking member from the ratchet teeth 32.

In one embodiment, the cable 14 is configured to be manually wound onto the spool 20. For example, a winding mechanism 42 connected to the spool 20 may be configured to be moved relative to the housing 12 to a winding position whereby a user is able to manually wind the cable 14 onto the spool. For example, the winding mechanism 42 could extend outwardly relative to the spool (see, e.g., FIGS. 6-7) for winding or unwinding the cable 14. In order to release the winding mechanism 42, a manual actuator 46 on the housing 12 may be configured to extend the winding mechanism outwardly relative to the housing. The winding mechanism 42 could be released manually so that the cable 14 is able to be wound onto the spool 20 and then manually reinserted into the housing 12 once a desired tension of the cable about the item of merchandise has been achieved. In one embodiment, actuating the manual actuator 40 allows a user to unwind a desired portion of cable 14 from the spool 20 and to thereby access the manual actuator 46 on the underside of the housing 14 for releasing the winding mechanism 42. In some instances, reinserting or engaging the winding mechanism 42 within the housing 12 may automatically cause the locking member 34 to engage the ratchet teeth 32.

In other embodiments, the housing 12 includes a retraction mechanism for automatically winding or recoiling the cable 14 into the housing 12. The cable 14 is operable to unwind as tension is applied to the cable, while the retraction mechanism may be configured to bias the spool 20 in a direction that automatically winds the cable 14 onto the spool when tension is removed. In some cases, the retraction mechanism includes a coiled or clock spring for biasing the spool in a winding direction. The spring is configured to wind as the cable 14 is withdrawn from the spool 20, such that the spring is configured to unwind and to bias the spool in an opposite winding direction to retract the cable onto the spool when tension is reduced or is no longer applied to the cable. In one example, the retraction mechanism may include a recoiler for retracting the cable 14 within the housing 20.

Moreover, the housing 12 may include at least one sensor 44 that is configured to be activated upon unauthorized removal of the housing 12 from an item of merchandise when the alarm circuit 24 is in an armed state. Furthermore, the sensor 44 may be in electrical communication with the alarm circuit 24. Thus, the alarm circuit 24 may be configured to detect activation of the sensor 44 and to communicate with an alarm 48 for generating an audible and/or a visible alarm signal in response to the sensor being activated. In one example, the sensor 44 may be a pressure, limit, or plunger switch, which may be used to detect removal of the housing 12 from the item of merchandise or movement of the housing relative to the item. In some instances, the sensor 44 is configured to move in one dimension, two dimensions, or three dimensions (i.e., X-, Y-, and Z-directions) for detecting lateral and/or vertical movement of the housing 12 relative to the item of merchandise. The sensor 44 may be a ball, a wheel, a rotary encoder, an optical encoder or sensor, a Hall-effect sensor, or the like, for determining whether the housing 12 has traveled a particular distance or rotated through a particular angle or number of revolutions. In order to facilitate vertical displacement of the sensor 44, the sensor may be biased (e.g., spring loaded) outwardly from the housing 12 to maintain contact with the item of merchandise. In this instance, the sensor 44 may be configured to deflect vertically upward towards the housing 12 when engaged with the item of merchandise. In one embodiment, the sensor 44 is configured to not only translate in the X- and Y-directions to detect movement of the housing 12 along the surface of the item of merchandise, but to also move vertically in the Z-direction to detect lifting of the housing 12 off of the item of merchandise. It is understood that the sensor 44 may be a single component or multiple components, or a plurality of sensors may be employed (e.g., a plunger switch and a rotatable member). For example, FIG. 4 shows that a rotary sensor 44 may be employed, while FIGS. 6-7 show that both a rotary sensor 44 and a plunger switch 44' may be used. In one embodiment, activation of the rotary sensor 44 may cause a pre-alarm, whereby the alarm circuit 42 causes an initial alarm signal to be generated. If the movement of the rotary sensor 44 ceases, then no further alarm signal would be generated, but if additional movement is detected, then a full alarm may be generated that is of a greater volume, frequency, and/or duration than the initial alarm signal. In one embodiment, actuation of the sensor 44 may automatically arm the alarm circuit 24.

In the illustrated embodiments of FIGS. 4-7, it can be seen that the spool 20 and lock mechanism 30 may be positioned within a portion of the housing 12 positioned adjacent to one surface of the item of merchandise, while the alarm circuit 24 and sensor 44 may be positioned within a second portion of the housing positioned on a second surface of the item of merchandise. One or both portions of the housing 12 may include one or more sensors 44.

In one embodiment, a key may be employed to lock and/or unlock the lock mechanism 30 and/or to arm and/or disarm the alarm circuit 24. In one embodiment, actuation of the locking mechanism 30 results in arming of the alarm circuit 24. Thus, in one embodiment, a key is not required to arm the alarm circuit 24. However, the key may be used to disarm the alarm circuit 24 and/or to unlock the locking mechanism 30. In one embodiment, the merchandise security device 10 may be configured to cooperate with an electronic key. The electronic key may utilize power transferred from the key and/or utilize data (e.g., a security code) transferred from the key to operate the locking mechanism and/or the alarm circuit 24. The electronic key may include a security code configured to unlock and/or disarm the merchandise security device 10 if the security code matches the security code of the merchandise security device. Alternatively or in addition, the electronic key may be configured to transfer power to the merchandise security device 10 for operating the locking mechanism 30 and/or disarming the alarm circuit 24. In some cases, data may be configured to be transferred by the electronic key when power is transferred to the merchandise security device 10. In some embodiments, power and/or data is transferred between the electronic key and the merchandise security device 10 via magnetic induction through an inductive coil. The locking mechanism 30 and/or alarm circuit 24 may be configured to recognize a particular inductive signal (e.g., power and/or frequency) from the electronic key for unlocking and/or disarming. The electronic key may communicate with the merchandise security device using any suitable means, wired or wirelessly, including without limitation, via one or more electrical contacts, optics, acoustics, radiofrequency, inductance, etc., as desired.

In some embodiments, the merchandise security device and the electronic key are similar to those disclosed in U.S. Patent Publication No. 2016/0307417, entitled Wrap for an Item of Merchandise and filed Nov. 13, 2014, and U.S. Patent Publication No. 2016/0049055, entitled Security Devices for Products and filed Apr. 9, 2014, the disclosure of each is incorporated herein by reference in its entirety.

The foregoing has described one or more embodiments of a merchandise display security system for use with a key. Embodiments of a merchandise security device have been shown and described herein for purposes of illustrating and enabling the best mode of the invention. Those of ordinary skill in the art, however, will readily understand and appreciate that numerous variations and modifications of the invention may be made without departing from the spirit and scope of the invention. Accordingly, all such variations and modifications are intended to be encompassed by the appended claims.

That which is claimed is:

1. A merchandise security device for securing an item of merchandise from theft, the merchandise security device comprising:

a housing operably coupled with a cable, the cable configured to be extended and retracted relative to the housing and to at least partially surround an item of merchandise, wherein the housing is configured to be positioned on a surface of the item of merchandise;

at least one sensor operably engaged with the housing and configured to engage the item of merchandise for detecting unauthorized movement of the housing relative to the item of merchandise in each of a lateral direction and a vertical direction relative to the surface of the item of merchandise; and a lock mechanism configured to lock the cable about the item of merchandise.

2. The merchandise security device of claim 1, wherein the lock mechanism is not required to cooperate with a key for unlocking the lock mechanism so that the housing and the cable may be removed from the item of merchandise.

3. The merchandise security device of claim 1, wherein the housing comprises an alarm circuit, and wherein the alarm circuit is configured to generate a security signal in response to unauthorized movement of the housing.

4. The merchandise security device of claim 1, wherein the housing is L-shaped and is configured to be positioned adjacent to two sides of the item of merchandise and to extend over an edge of the item of merchandise.

5. The merchandise security device of claim 1, further comprising a winding mechanism configured to manually wind the cable into the housing.

6. The merchandise security device of claim 1, wherein the cable is operably engaged with a spool disposed within the housing.

7. The merchandise security device of claim 6, wherein the lock mechanism is configured to lock the spool relative to the housing such that the cable is configured to be retracted within the housing but not extended out of the housing.

8. The merchandise security device of claim 1, wherein the cable consists of a single loop.

9. The merchandise security device of claim 8, wherein the housing defines a pair of openings, each of the openings configured to receive the cable therethrough.

10. The merchandise security device of claim 1, wherein the lock mechanism is a ratchet mechanism.

11. The merchandise security device of claim 1, wherein the lock mechanism is configured to prevent the cable from being extended from the housing but not from being retracted into the housing.

12. The merchandise security device of claim 1, wherein the at least one sensor comprises a rotatable mechanism configured to engage the item of merchandise.

13. The merchandise security device of claim 1, wherein the at least one sensor comprises a rotatable mechanism and a plunger switch configured to engage the item of merchandise.

14. The merchandise security device of claim 1, wherein the cable is a mechanical cable and does not include any electrical conductors.

15. The merchandise security device of claim 1, wherein the at least one sensor is further configured to detect vertical movement of the housing relative to the item of merchandise in the vertical direction that is perpendicular to the surface of the item of merchandise.

16. The merchandise security device of claim 1, wherein the housing is configured to be positioned in direct contact with the item of merchandise, and wherein the sensor is configured to extend outwardly from the housing for directly engaging the item of merchandise.

17. The merchandise security device of claim 1, wherein the cable is configured to surround four sides of a six-sided item of merchandise but is not configured to surround all six sides of the six-sided item of merchandise.

18. The merchandise security device of claim 1, further comprising a retraction mechanism configured to automatically wind the cable into the housing.

19. A merchandise security device for securing an item of merchandise from theft, the merchandise security device comprising:

a housing configured to be positioned adjacent to two sides of a six-sided item of merchandise and to extend over an edge of the item of merchandise;

a cable operably coupled with the housing, the cable configured to be extended and retracted relative to the housing and to at least partially surround four sides of the item of merchandise but not configured to surround all six sides of the item of merchandise;

at least one sensor operably engaged with the housing and configured to engage the item of merchandise for detecting unauthorized movement of the housing relative to the surface of the item of merchandise in each of a lateral direction and a vertical direction; and a lock mechanism configured to lock the cable about the item of merchandise.

20. A method for securing an item of merchandise from theft, the method comprising:

positioning a housing on a surface of the item of merchandise such that a sensor operably engaged with the housing engages the item of merchandise, the sensor configured to detect unauthorized movement of the housing relative to the surface of the item of merchandise in each of a lateral direction and a vertical direction, the housing operably coupled with a cable configured to be extended and retracted relative to the housing;

at least partially surrounding the item of merchandise with the cable; and engaging a lock mechanism for releasably securing the cable relative to the housing to prevent extension of the cable relative to the housing but not to prevent retraction of the cable within the housing.

* * * * *